US007257193B2

(12) United States Patent
Radley et al.

(10) Patent No.: US 7,257,193 B2
(45) **Date of Patent: *Aug. 14, 2007**

(54) X-RAY SOURCE ASSEMBLY HAVING ENHANCED OUTPUT STABILITY USING TUBE POWER ADJUSTMENTS AND REMOTE CALIBRATION

(75) Inventors: Ian Radley, Glenmont, NY (US); Michael D. Moore, Alplaus, NY (US); Mark Fitzgerald, Guilderland, NY (US)

(73) Assignee: X-Ray Optical Systems, Inc., East Greenbush, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/347,668

(22) Filed: Feb. 3, 2006

(65) Prior Publication Data

US 2006/0193438 A1 Aug. 31, 2006

Related U.S. Application Data

(63) Continuation of application No. PCT/US2004/025113, filed on Aug. 4, 2004.

(60) Provisional application No. 60/492,353, filed on Aug. 4, 2003.

(51) Int. Cl.
*H05G 1/26* (2006.01)

(52) U.S. Cl. ..... 378/108; 378/145

(58) Field of Classification Search ..... 378/137, 378/193, 197, 205, 145, 148, 108, 125, 97
See application file for complete search history.

(56) References Cited

U.S. PATENT DOCUMENTS 2,121,630 A 6/1938 Gross et al. ..... 250/34
2,825,816 A 3/1958 Rogers ..... 250/95
2,831,977 A 4/1958 Henke ..... 250/53
4,039,811 A 8/1977 Ennslin et al. ..... 250/409
4,172,223 A 10/1979 Ishijima et al. ..... 250/272
4,674,109 A 6/1987 Ono ..... 378/130
4,837,792 A 6/1989 Goethert ..... 378/4

(Continued)

FOREIGN PATENT DOCUMENTS

DE 195 40 195 A1 5/1997

(Continued)

*Primary Examiner*—Hoon Song
(74) *Attorney, Agent, or Firm*—Jeffrey Klembczyk, Esq.; Kevin P. Radigan, Esq.; Heslin Rothenberg Farley & Mesiti, P.C.

(57) ABSTRACT

An x-ray source assembly includes an anode having a spot upon which electrons impinge based on power level supplied to the assembly, and an optic coupled to receive divergent x-rays generated at the spot and transmit output x-rays from the assembly. A control system is provided for maintaining intensity of the output x-rays dynamically during operation of the x-ray source assembly, notwithstanding a change in at least one operating condition of the x-ray source assembly, by changing the power level supplied to the assembly. The control system may include at least one actuator for effecting the change in the power level supplied to the assembly, by, e.g., controlling a power supply associated with the assembly. The control system may also change the temperature and/or the position of the anode to maintain the output intensity.

23 Claims, 14 Drawing Sheets

U.S. PATENT DOCUMENTS

| | | | | |
|---|---|---|---|---|
| 4,891,829 | A | 1/1990 | Deckman et al. | |
| 4,930,145 | A | 5/1990 | Sherwin et al. | 378/109 |
| 4,979,199 | A | 12/1990 | Cueman et al. | 378/121 |
| 5,016,267 | A | 5/1991 | Wilkins | 378/84 |
| 5,067,146 | A | 11/1991 | Meinel et al. | |
| 5,177,774 | A | 1/1993 | Suckewer et al. | 378/43 |
| 5,272,618 | A | 12/1993 | Blake | 363/79 |
| 5,550,886 | A * | 8/1996 | Dobbs et al. | 378/19 |
| 5,550,889 | A | 8/1996 | Gard et al. | |
| 5,581,591 | A | 12/1996 | Burke et al. | |
| 5,778,039 | A | 7/1998 | Hossain et al. | 378/45 |
| 6,185,276 | B1 | 2/2001 | Eastman | 378/143 |
| 6,339,635 | B1 | 1/2002 | Schardt et al. | 378/137 |
| 6,345,086 | B1 | 2/2002 | Ferrandino et al. | 378/44 |
| 6,351,520 | B1 | 2/2002 | Inazaru | 378/138 |
| 6,577,704 | B1 | 6/2003 | Holz | 378/44 |
| 2005/0053197 | A1 * | 3/2005 | Radley et al. | 378/193 |
| 2006/0193438 | A1 * | 8/2006 | Radley et al. | 378/119 |

FOREIGN PATENT DOCUMENTS

| | | | |
|---|---|---|---|
| JP | 05-329143 | | 12/1993 |
| WO | WO01/02842 | A2 | 1/2001 |
| WO | WO 03/049510 | A2 | 6/2003 |
| WO | WO 2005/018289 | A2 | 2/2005 |

* cited by examiner

| | HOUSING TEMPERATURE | | | | | | | | | | |
|---|---|---|---|---|---|---|---|---|---|---|---|
| ANODE POWER LEVEL | 20° | 21° | 22° | 23° | 24° | 25° | 26° | 27° | 28° | 29° | 30° |
| 0W | | | | | | | | | | | |
| 10W | | | | | | | | | | | |
| 20W | | | | | | | | | | | |
| ⋮ | ⋮ | ⋮ | ⋮ | ⋮ | ⋮ | ⋮ | ⋮ | ⋮ | ⋮ | ⋮ | ⋮ |
| 100W | | | | | | | | | | | |

*fig. 10*

| | VOLTAGE (kv) | | | | | | | | |
|---|---|---|---|---|---|---|---|---|---|
| CURRENT (ma) | | | | | | | | | |
| | | | | | | | | | |
| | | | | | | | | | |
| | | | | | | | | | |
| | | | | | | | | | |
| | | | | | | | | | |

ENTRIES: MAXIMUM DESIRED INTENSITY

*fig. 10A*

X-RAY SOURCE ASSEMBLY HAVING ENHANCED OUTPUT STABILITY USING TUBE POWER ADJUSTMENTS AND REMOTE CALIBRATION

RELATED APPLICATION INFORMATION

This application is a continuation of PCT Application PCT/US04/25113 filed Aug. 4, 2004, and published under the PCT Articles in English as WO 2005/018289 A2 on Feb. 24, 2005. PCT/US2004/025113 claimed priority to U.S. Provisional Application No. 60/492,353, filed Aug. 4, 2003. The entire disclosures of PCT/US2004/025113 and U.S. Ser. No. 60/492,353 are incorporated herein by reference in their entirety. In addition, this application contains subject matter which is related to the subject matter of the following applications, which are hereby incorporated herein by reference in their entirety:

- "X-RAY TUBE AND METHOD AND APPARATUS FOR ANALYZING FLUID STREAMS USING X-RAYS," by Radley et al., U.S. Ser. No. 60/336,584, filed Dec. 4, 2001 and perfected as PCT application PCT/US02/38792;
- "X-RAY SOURCE ASSEMBLY HAVING ENHANCED OUTPUT STABILITY" by Radley et al., U.S. Ser. No. 60/398,965, filed Jul. 26, 2002 and perfected as PCT application PCT/US02/38493.
- "METHOD AND DEVICE FOR COOLING AND ELECTRICALLY-INSULATING A HIGH-VOLTAGE, HEAT-GENERATING COMPONENT", by Radley, U.S. Ser. No. 60/398,968, filed Jul. 26, 2002, perfected as PCT application PCT/US02/38803; and
- "DIAGNOSING SYSTEM FOR AN X-RAY SOURCE ASSEMBLY", by Radley et al., U.S. Ser. No. 60/398,966, filed Jul. 26, 2002, perfected as PCT application PCT/US03/23129.

TECHNICAL FIELD

The present invention relates generally to x-ray sources, and more particularly, to x-ray source assemblies having a focused or collimated x-ray beam output with enhanced stability and automated calibration over a range of operating conditions using a control loop for adjusting tube power according to desired intensity.

BACKGROUND OF THE INVENTION

Small, compact x-ray tubes have experienced widespread adoption in instruments for x-ray fluorescence (XRF) spectroscopy and x-ray diffraction (XRD) for a wide range of industrial, medical and dental applications. X-ray tubes conventionally emit radiation in a divergent manner. Obtaining an illumination spot size of sufficient intensity typically necessitated expensive, high-powered sources. The recent ability to focus x-ray radiation has enabled reductions in the size and cost of x-ray sources, and hence x-ray systems have been adopted in a variety of applications. X-ray beam production and transmission is exemplified by the polycapillary focusing and collimating optics and the in optic/source combinations such as those disclosed in commonly assigned, X-Ray Optical Systems, Inc. U.S. Pat. Nos. 5,192,869; 5,175,755; 5,497,008; 5,745,547; 5,570,408; and 5,604,353; and the above-identified U.S. patent applications—all of which are incorporated by reference herein in their entirety.

While progress in x-ray focusing has recently been achieved, further enhancements to x-ray source assemblies are still required. For example, improving the output stability of an x-ray beam under a variety of operating conditions, and calibration of their operation under known conditions. The present invention is directed to these requirements.

SUMMARY OF THE INVENTION

The use of e-beam impingement upon an anode to generate x-rays, in the x-ray sources described above, can generate an amount of heat sufficient to cause thermal expansion of the elements which support and position the x-ray tube within the x-ray source. This thermal expansion can cause misalignment between the x-rays diverging from the anode and, e.g., the element that serves to control the direction of the x-rays. As a result, operating an x-ray source at different powers may lead to a range of misalignments between the diverging x-rays and the focusing optic. This misalignment could cause the output power intensity of the x-ray source to vary widely. Misalignment could also cause changes in x-ray output spot or x-ray beam position for some types of beam controlling elements, e.g., for pinholes or single reflection mirrors. Thus, in one aspect, provided herein is an x-ray source assembly having enhanced output stability over a range of operating power levels, as well as enhanced x-ray spot or x-ray beam position stability. More particularly, an x-ray source assembly in accordance with an aspect of the present invention provides an x-ray beam output intensity which can be maintained relatively constant notwithstanding variation in one or more operating conditions of the x-ray source, such as anode power level, housing temperature and ambient temperature about the assembly.

An x-ray source assembly in accordance with the present invention includes an anode having a spot upon which electrons impinge based on power level supplied to the assembly, and an optic coupled to receive divergent x-rays generated at the spot and transmit output x-rays from the assembly. A control system is provided for maintaining intensity of the output x-rays dynamically during operation of the x-ray source assembly, wherein the control system maintains the output intensity notwithstanding a change in at least one operating condition of the x-ray source assembly, by changing the power level supplied to the assembly.

The control system may include at least one actuator for effecting the change in the power level supplied to the assembly, by, e.g., controlling a power supply associated with the assembly.

The control system may also change the temperature and/or the position of the anode to maintain the output intensity. Actuators may be provided for adjusting position of at least one of the anode source spot and the output structure; and/or for performing at least one of heating and cooling of the anode and thereby effectuating adjustment of the anode relative to the optic.

The control system further may include at least one sensor for providing feedback related to output intensity; and additional sensors for monitoring anode power level; and/or directly or indirectly the anode temperature.

Systems and computer program products corresponding to the above-summarized methods are also described and claimed herein.

Further, additional features and advantages are realized through the techniques of the present invention. Other embodiments and aspects of the invention are described in detail herein and are considered a part of the claimed invention.

BRIEF DESCRIPTION OF THE DRAWINGS

The subject matter regarded as the invention is particularly pointed out and distinctly claimed in the claims at the conclusion of the specification. The foregoing and other objects, features, and advantages of the invention are apparent from the following detailed description taken in conjunction with the accompanying drawings in which:

FIGS. 10-10*a* are exemplary reference temperature and maximium intensity tables which can be employed by the control processing of FIGS. 9-9*a*, in accordance with aspects of the present invention.

DETAILED DESCRIPTION OF THE INVENTION

As generally discussed above, the present invention provides in one aspect an x-ray source assembly providing, for example, a focused x-ray beam or a collimated x-ray beam, and having a stable output over a range of operating conditions. This stable output is obtained via a control system which controls, in one aspect, power supplied to the source notwithstanding a change in one or more of the operating conditions.

The control system employs one or more actuators which can effect the necessary changes. For example, one actuator might comprise a power actuator which (in cooperation with a power supply) changes the power supplied to the tube; a temperature actuator which provides heating/cooling of the anode to effect adjustments in the anode source spot location relative to the output structure; or a mechanical actuator which would physically adjust position of either the anode source spot or the output structure as needed. Still another actuator might electrostatically or magnetically move the electron beam. One or more sensors can be employed by the control system to provide feedback on the anode source spot location relative to the output structure. The sensors may include temperature sensors, such as a sensor to directly or indirectly measure the anode temperature, as well as a housing temperature sensor and an ambient temperature sensor. The sensors may also include a feedback mechanism for obtaining the anode power level, or a direct or indirect measure of the optic output intensity.

As used herein, the phrase "output structure" refers to a structure comprising part of the x-ray source assembly or associated with the x-ray source assembly. By way of example, the structure could comprise an x-ray transmission window or an optic, such as a focusing or collimating optic, which may or may not be secured to a housing surrounding the x-ray tube within the assembly.

Figure 1:
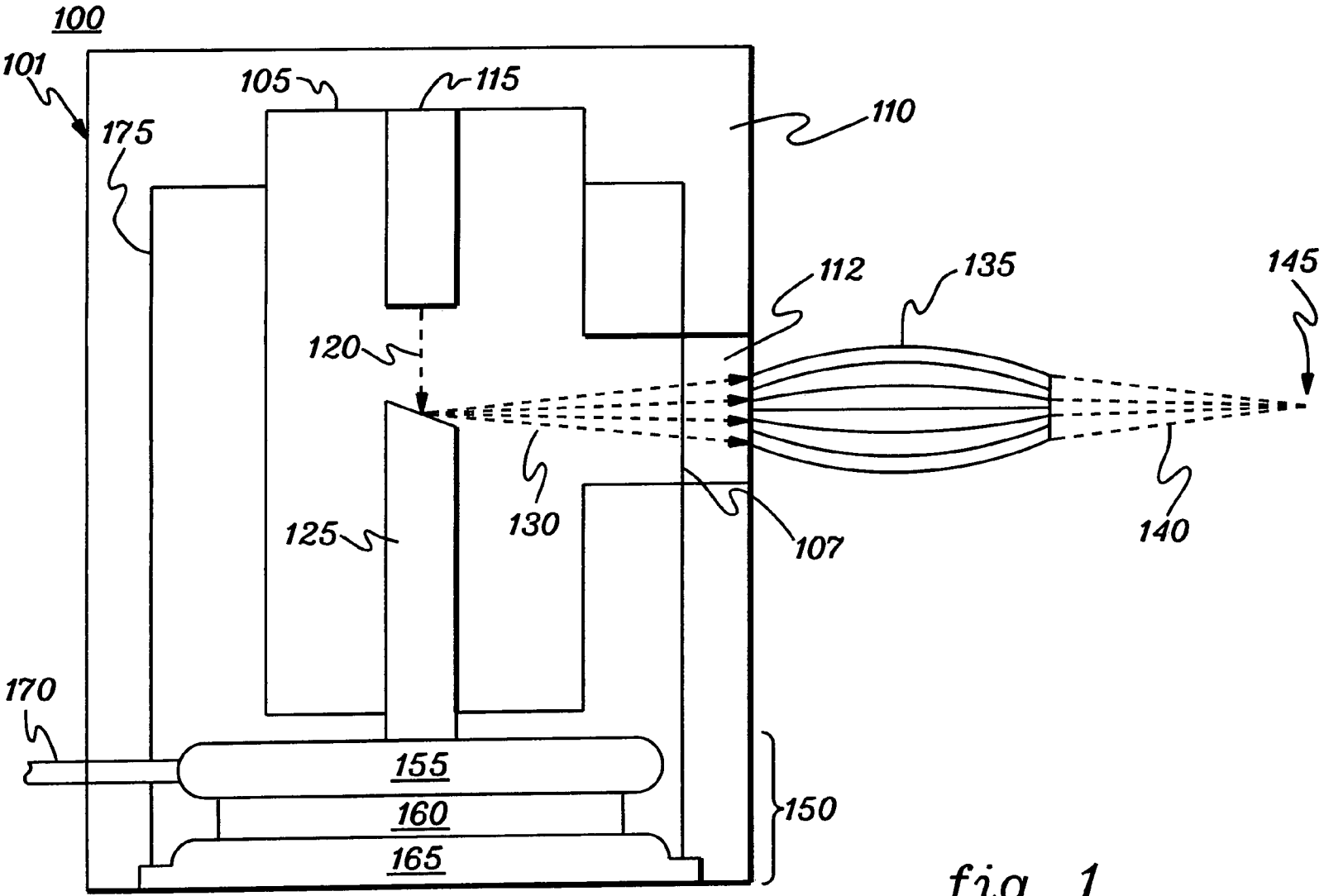
FIG. 1 depicts a cross-sectional view of one embodiment of an x-ray source assembly, in accordance with an aspect of the present invention.

FIG. 1 illustrates in cross-section an elevational view of an x-ray source assembly 100 in accordance with an aspect of the present invention. X-ray source assembly 100 includes a x-ray source 101 comprising a vacuum tight x-ray tube 105 (typically formed of glass or ceramic) having a transmission window 107. X-ray tube 105 houses an electron gun 115 arranged opposite a high-voltage (HV) anode 125. When voltage is applied, electron gun 115 emits electrons in the form of an electron stream, i.e., an electron beam (e-beam) 120, as is well known in the art. HV anode 125 acts as a target with a source spot upon which the electron stream impinges for producing x-ray radiation, i.e., x-rays 130.

By way of example, electron gun 115 could be held at ground potential (zero volts), while HV anode 125 is held at a high voltage potential, typically around 50 kv. As a result, e-beam 120 emitted from electron gun 115 at ground potential is electrically attracted to the surface of HV anode 125, thereby producing x-rays 130 from a source spot on the anode where e-beam 120 strikes the anode. X-rays 130 are subsequently directed through transmission window 107 of vacuum tight x-ray tube 105. Transmission window 107 is typically formed of a material such as beryllium (Be) which permits substantially unimpeded transmission of x-rays while still maintaining the vacuum within x-ray tube 105.

A housing 110 at least partially encloses x-ray tube 105. Housing 110 can include an aperture 112 aligned with transmission window 107 of x-ray tube 105. By way of example, aperture 112 could comprise an open aperture in housing 110 or an enclosed aperture defining an air space. Upon transmission through transmission window 107 and aperture 112, x-rays 130 are collected by an optic 135. Optic 135 is shown in this example centered about aperture 112 in housing 110. Optic 135 could be affixed to an exterior surface of housing 110, or could be partially disposed within housing 110 to reside within aperture 112 (e.g., to reside against transmission window 107), or could be separately supported from housing 110 but aligned to aperture 112 in housing 110.

As noted, optic 135 could comprise a focusing optic or a collimating optic, by way of example. In FIG. 1, optic 135 is shown to be a focusing element, which is useful when x-ray source 100 is utilized for applications requiring a high intensity, low diameter spot 145. Focusing optic 135 collects x-ray radiation 130 and focuses the radiation into converging x-rays 140. A focusing optic could be beneficial when x-ray source 100 is to be employed in connection with an x-ray fluorescence system which requires a low power source. As an alternative, optic 135 could comprise a collimating optical element for use in applications which require a parallel beam of x-ray radiation output from the optic (not shown). In the case of a collimating optical element, x-rays 140 would be parallel rather than converging to spot 145 as shown in FIG. 1.

Optic 135 could comprise any optical element capable of collecting or manipulating x-rays, for example, for focusing or collimating. By way of example, optic 135 could comprise a polycapillary bundle (such as available from X-ray Optical Systems, Inc. of Albany, N.Y.), a doubly curved optic or other optical element form, such as a filter, a pinhole or a slit. (A polycapillary optic is a bundle of thin, hollow tubes that transmit photons via total reflection. Such an optic is described, for example, in U.S. Pat. Nos. 5,175,755, 5,192,869, and 5,497,008. Doubly curved optics are described, for example, in U.S. Pat. Nos. 6,285,506 and 6,317,483. All of these patents are incorporated by reference herein in their entirety.) Upon calibration of x-ray source assembly 100, optic 135 remains stationary (in one embodiment) relative to x-ray source 101 until further calibration of x-ray source assembly 100 is performed.

The end of HV anode 125 opposite the impingement surface protrudes through the body of x-ray tube 105 and is mechanically and electrically connected to a base assembly 150. Base assembly 150 includes a first conductor disc 155 that is electrically isolated from a base plate 165 via a dielectric disc 160. The resulting anode 125 and base assembly 150 structure, referred to herein as the anode stack, is described in detail in the above-incorporated application entitled "Method and Device For Cooling and Electrically Insulating A High-Voltage, Heat Generating Component". Although described in greater detail therein, the structure and function of base assembly 150 are briefly discussed below.

Conductor disc 155 and base plate 165 are, for example, several inches in diameter, disc-shaped plates formed of a highly electrically conductive and highly thermally conductive material, such as copper. By way of example, conductor disc 155 and base plate 165 may have a thickness in the range of 0.1 to 0.5 inches, with 0.25 inches being one specific example. Base plate 165 may further include constructional detail to accommodate the overall structure of x-ray source 101.

Dielectric disc 160 is, for example, a 1.5-inch diameter, disc-shaped plate formed of a material that provides high dielectric strength at high voltages, such as beryllium oxide ceramic or aluminum nitride ceramic. In addition, while not as thermally conductive as conductor disc 155 or base plate 165, these materials do exhibit relatively good thermal conductivity. Dielectric disc 150 may have a thickness in the range of 0.1 to 0.5 inches, with 0.25 inches being one specific example.

Conductor disc 155 is mechanically and electrically connected to a high voltage source (not shown) via an appropriate high voltage lead 170. As a result, the high voltage potential is supplied to conductor disc 155 and subsequently to HV anode 125. Conversely, base plate 165 is held at ground potential. Dielectric disc 160 provides electrical isolation between high-voltage conductor disc 155 and the grounded base plate 165. One example of an assembly for connecting high voltage lead 170 to conductor disc 155 is described in the above-incorporated patent application entitled "An Electrical Connector, A Cable Sleeve, and A Method For Fabricating A High Voltage Electrical Connection For A High Voltage Device".

The x-ray tube 105, base assembly 150, and HV lead 170, may be encased in an encapsulant 175. Encapsulant 175 can comprise a rigid or semi-rigid material with a sufficiently high dielectric strength to avoid voltage breakdown, such as silicone. Furthermore, encapsulant 175 need not be a good thermal conductor since the preferred thermal path is through base assembly 150. As a specific example, encapsulant 175 could be formed by molding a silicon elastomer (such as Dow Sylgard® 184 available from Dow Chemical), around the x-ray tube, base assembly and high voltage lead, thereby forming a structure which is void of air pockets which might provide an undesirable voltage breakdown path to ground.

Figure 2:
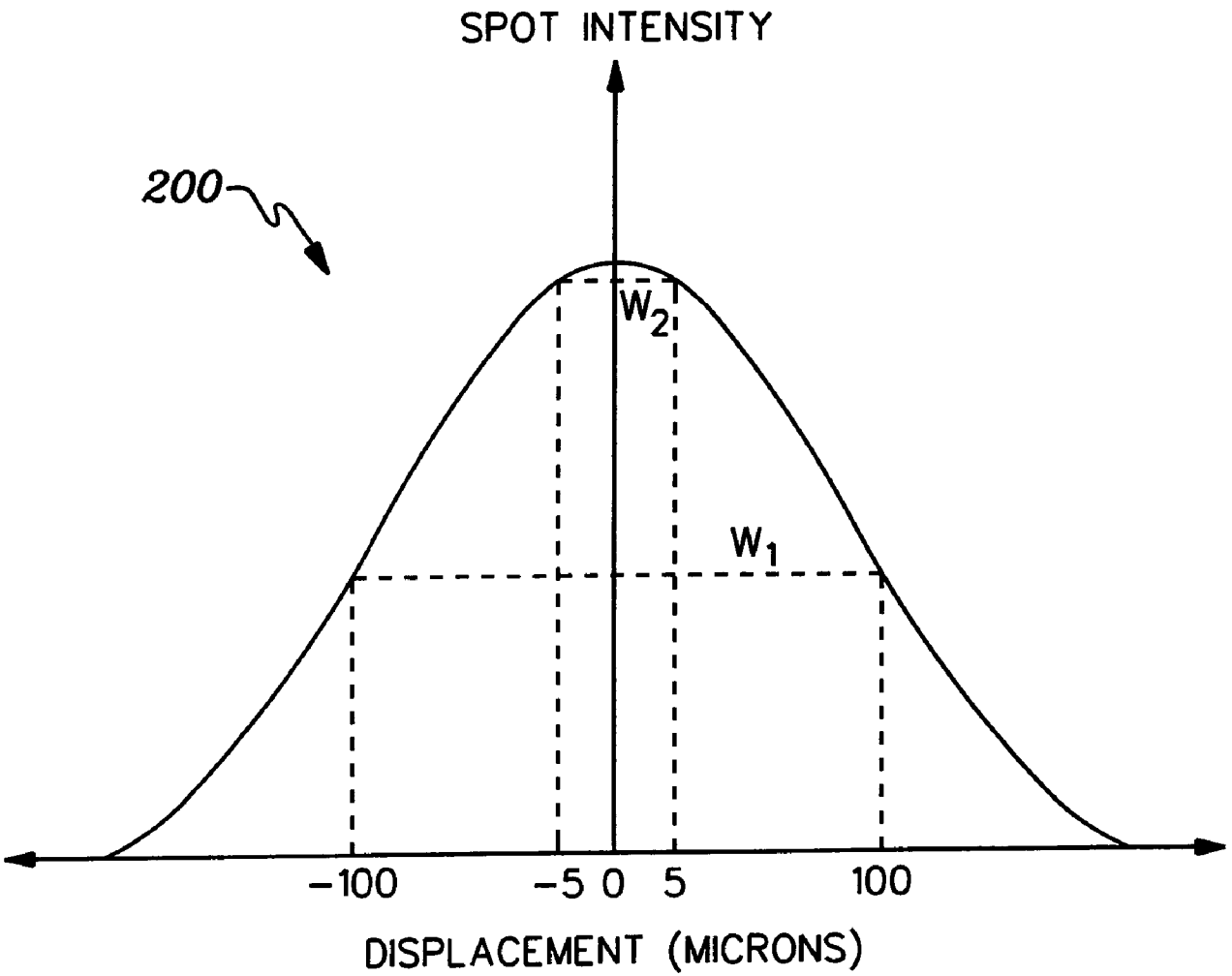
FIG. 2 depicts one example of a source scan curve for an x-ray source such as shown in FIG. 1 plotting output intensity versus displacement, in accordance with an aspect of the present invention.

FIG. 2 graphically illustrates a source scan curve 200 in which a representation of output intensity, e.g., spot 145 (FIG. 1) intensity, is plotted with respect to displacement or misalignment between the anode source spot and the output optic. The spot intensity results from scanning x-rays (130) across the focal point of optic (135). It is shown that a Gaussian plot results, in which a maximum intensity is achieved with proper alignment of x-rays 130 (and thus the anode source spot) at the focal point of the optic.

As shown, the full width W1 at half maximum (FWHM) is equal to approximately 200 microns. A FWHM of 200 microns indicates that the x-ray intensity at spot 145 drops 50% as a result of displacement of x-rays 130 (and thus the anode source spot) a distance of 100 microns from the focal point of optic 135. When properly calibrated, x-ray source assembly 100 functions for a given power near the top of the source scan curve of FIG. 2, where the slope is approximately equal to zero, such that minor perturbations in the displacement of x-rays 130 (e.g., 5 micrometers or less) with respect to optic 135 result in a negligible intensity drop. By way of example, the range of allowable perturbations in the displacement of x-rays 130 with respect to optic 135 is represented by W2, indicating that a displacement less than five microns between x-rays 130 and the focal point of optics 135 is acceptable. However, a difference in the thermal expansion of as much as 50 microns can occur in HV anode 125 and the elements of base assembly 150 as the operating power of the x-ray source varies from 0 to 50 W.

Figure 3:
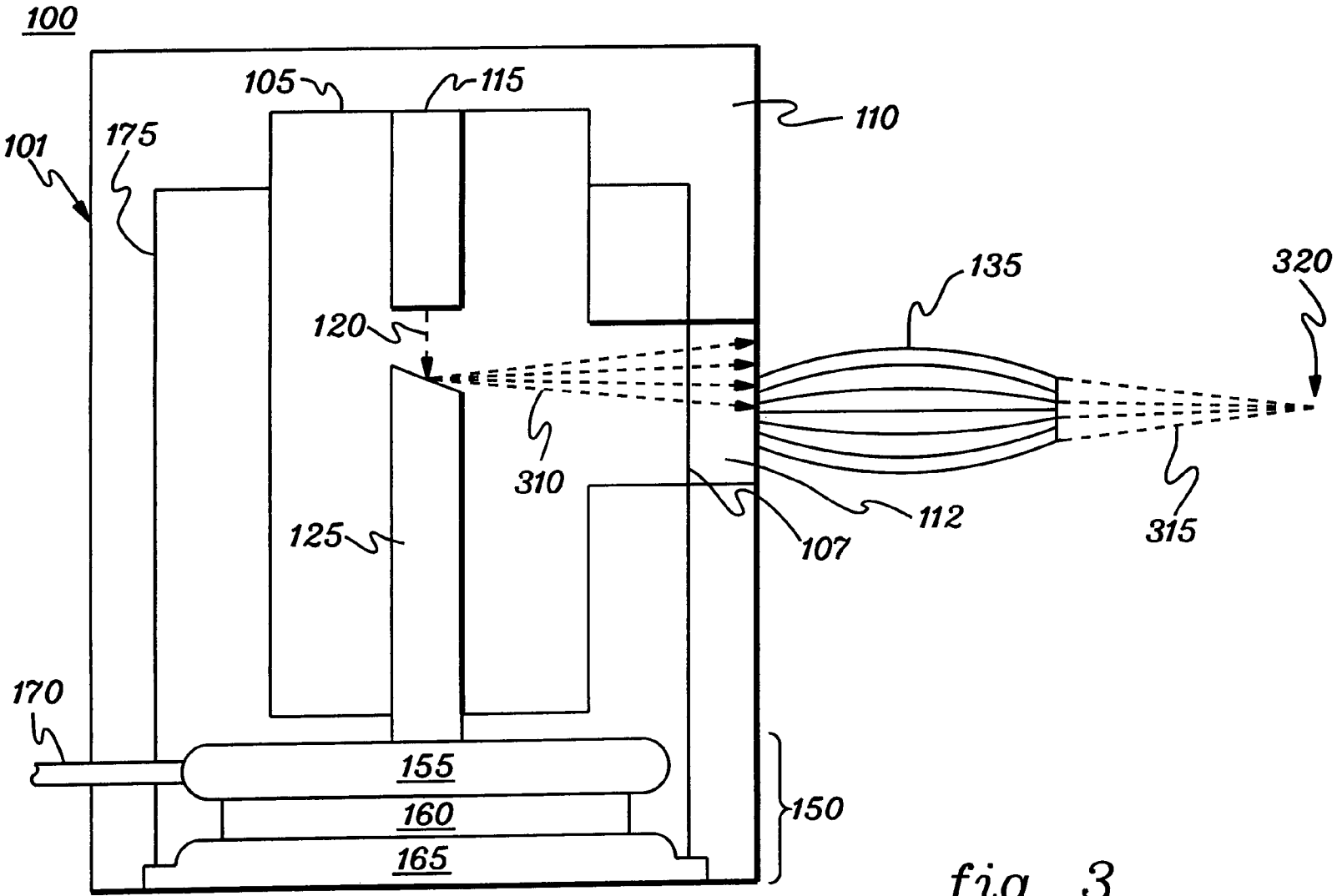
FIG. 3 depicts a cross-sectional view of the x-ray source assembly of FIG. 1 showing a source spot to optic misalignment, which is addressed in accordance with an aspect of the present invention.

FIG. 3 depicts x-ray source 100 as described above in connection with FIG. 1. In this example, however, heat generated by e-beam 120 impinging on HV anode 125 has caused HV anode 125, conductor disc 155, base plate 165, and to a lesser extent, dielectric disc 160, to expand. As a result of this expansion, a divergent beam of x-rays 310 is generated that is displaced vertically with respect to x-rays 130 illustrated in FIG. 1. For example, if the x-ray tube or target of electron gun 115 are operated at a power of 50 W, the focal point of x-rays 310 may be displaced by as much as 50 microns from its position at 0 W. X-rays 310 are misaligned with optic 135 and, as a result, the convergent beam of x-rays 315 produces a spot 320 of markedly reduced intensity.

Other environmental conditions may cause this displacement. As discussed below, the present invention is related to compensating for this displacement by dynamically changing the power supplied to the tube.

Due to the physical nature of collimating optics and focusing optics, such as doubly curved crystals and polycapillary bundles, precise positioning of optic 135 relative to the anode source spot is desirable for optimum collimation or focusing of x-rays 315. As a result, a displacement of x-rays 310 with respect to optic 135 such as may result from thermal expansion of HV anode 125 and base assembly 150 can result in a spot 320 having significantly reduced intensity, as illustrated graphically in FIG. 2.

Figure 5:
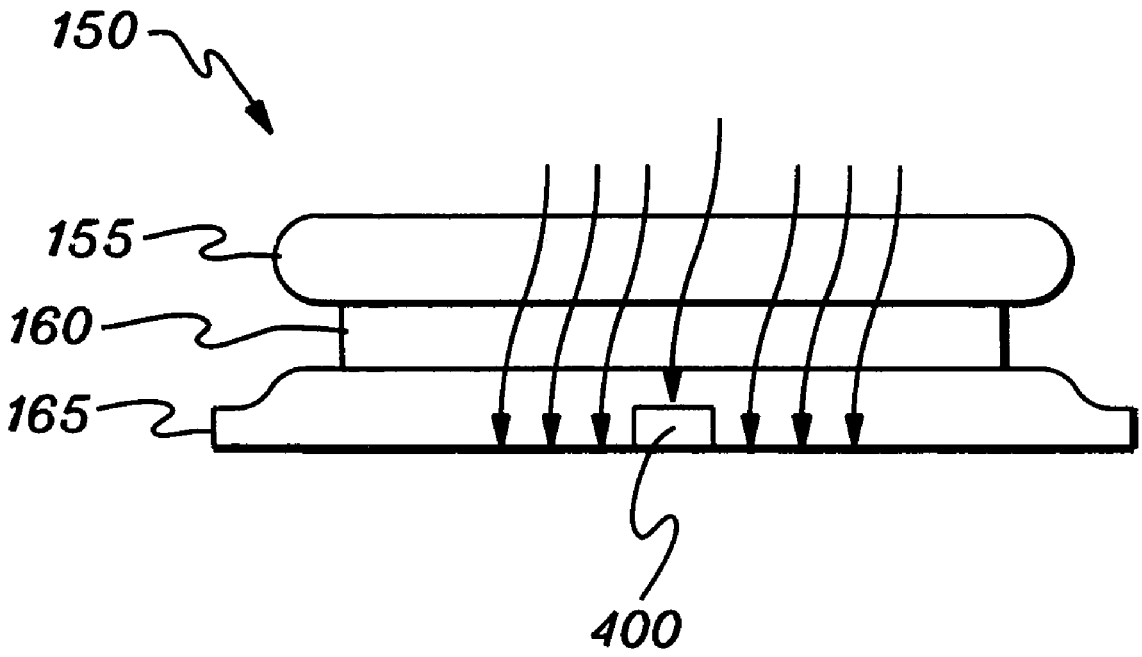
FIG. 5 is a cross-sectional view of one embodiment of the anode base assembly depicted in FIGS. 1, 3 & 4, in accordance with an aspect of the present invention.

The anode source spot to an output structure offset can be measured using various approaches. For example, a temperature sensor 400 could be employed at the base of the anode stack to measure changes in anode stack temperature, which as described further below can be correlated to the anode source spot to optic offset during a calibration procedure. FIG. 5 shows an alternative temperature sensor implementation.

As shown in FIG. 5, base assembly 150, again including conductor disc 155, dielectric disc 160 and base plate 165, is modified to include a temperature sensor 400 recessed within and in good thermal contact with base plate 165. For illustrative purposes, FIG. 5 depicts waves which represent heat transfer from the anode, to and through the base assembly. These waves represent heat which is generated by the impingement of e-beam 120 upon HV anode 125 as shown in FIG. 4.

Figure 4:
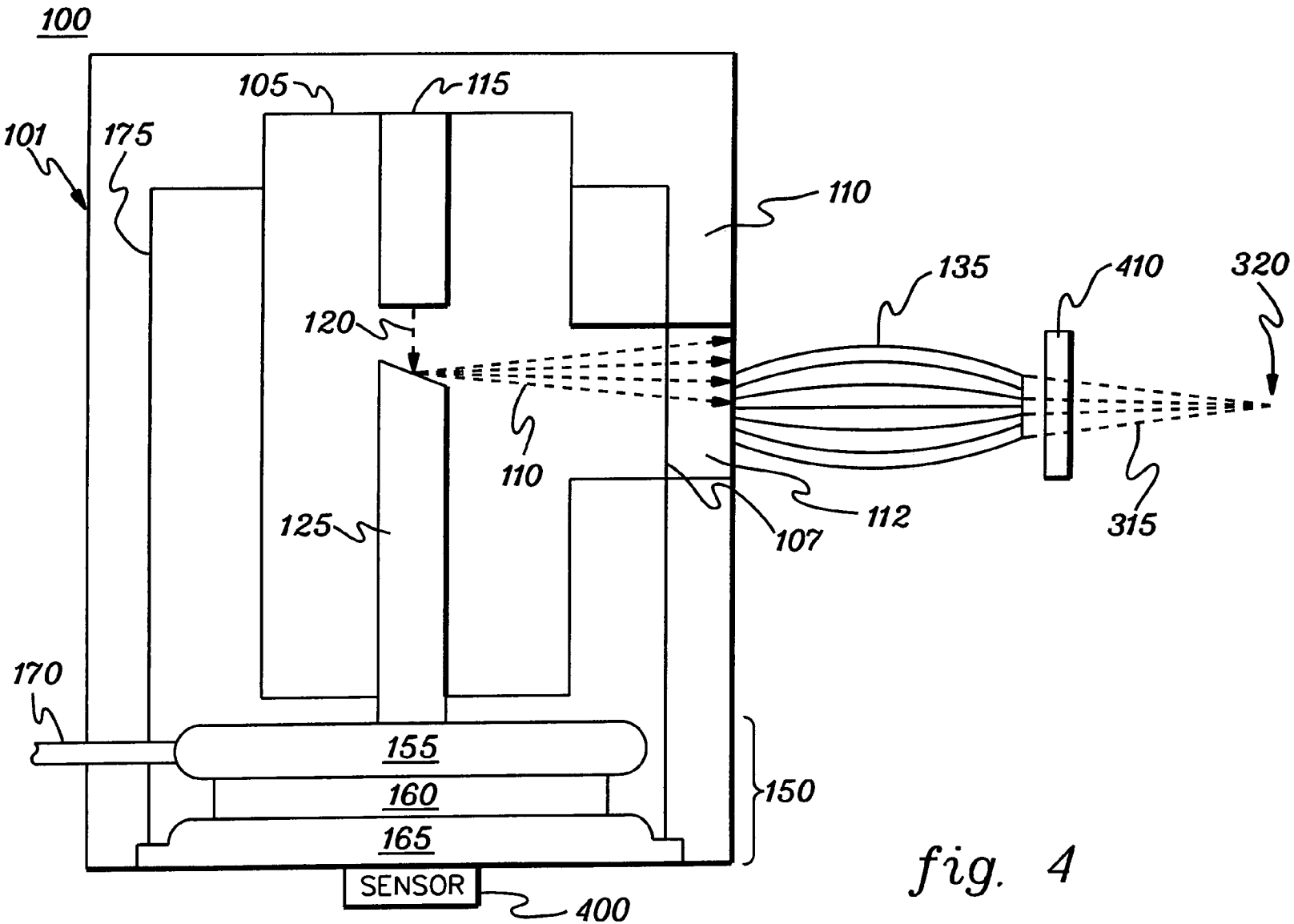
FIG. 4 depicts a cross-sectional view of the x-ray source assembly of FIG. 3 showing different sensor placements for monitoring source spot to optic displacement, in accordance with an aspect of the present invention.

Also depicted in FIG. 4 is an x-ray intensity measurement device 410. In addition to, or as an alternative to, sensing temperature to determine offset, x-ray output intensity of either x-ray source 101 or optic 135 could be measured. By way of example, in a diffraction application, an ion chamber or a proportional counter could be used as an intensity measurement device 410 in order to provide the needed feedback for a position control system such as described herein. In a diffraction application, the energy of interest is typically only at one wavelength and thus a proportional counter disposed within the x-ray path only absorbs a small amount of the x-rays of interest. Those skilled in the art will recognize that other intensity measurement approaches could be employed to directly or indirectly determine the intensity of x-rays output from the x-ray source assembly 100. The goal of temperature sensing, x-ray intensity sensing, etc., is to provide feedback information on the alignment between the anode source spot and the output structure. A control system and a control process are described further below with reference to FIGS. 7-10.

Figure 6:
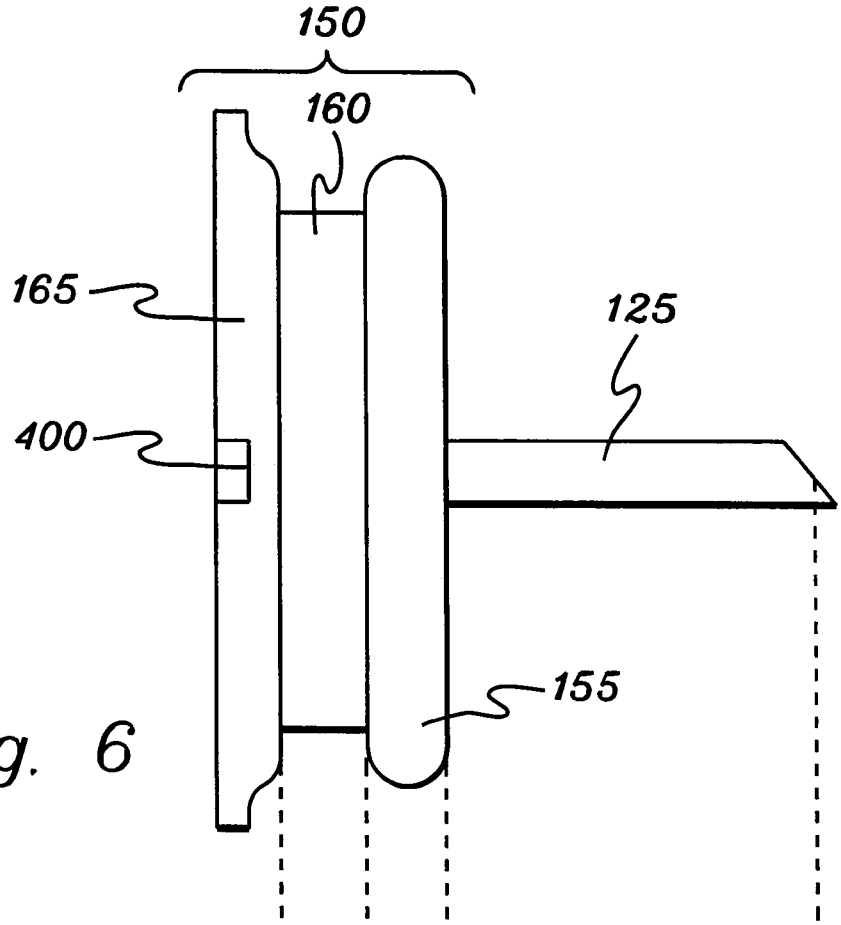
FIG. 6 is a cross-sectional view of the anode stack of FIGS. 1, 3 & 4, in accordance with an aspect of the present invention.
Figure 6A:
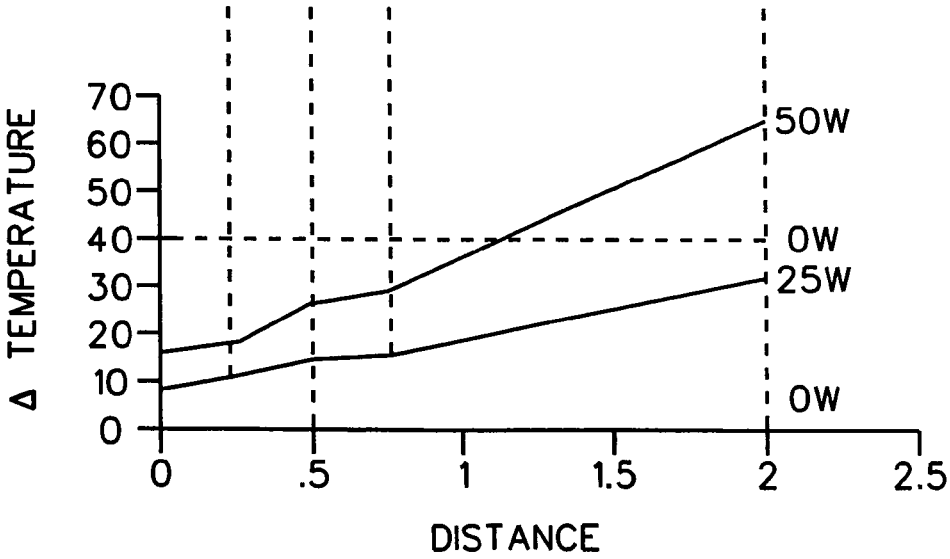
FIG. 6A is a graphical representation of change in temperature across the elements of the anode stack for different anode power levels, in accordance with an aspect of the present invention.
Figure 6B:
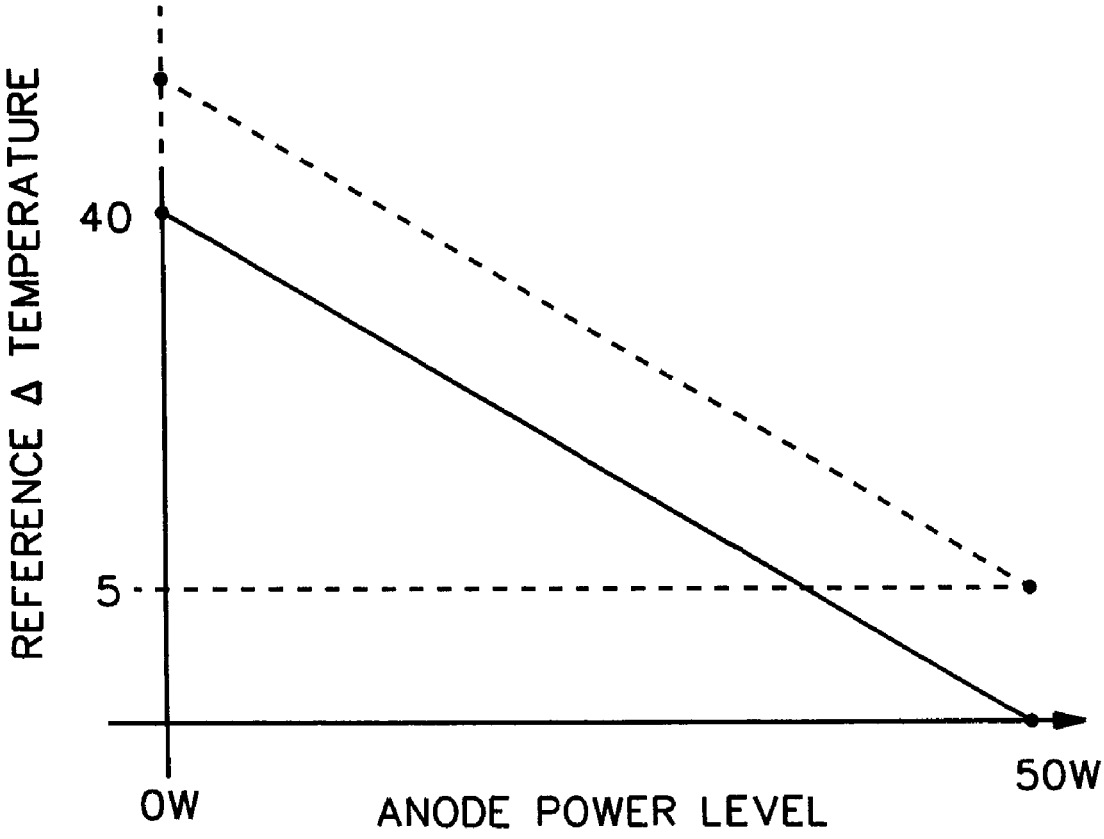
FIG. 6B is a graph of change in reference temperature as a function of anode power level, in accordance with an aspect of the present invention.

The correlation between anode stack temperature and anode source spot to output structure alignment can be better understood with reference to FIGS. 6-6B.

In FIG. 6, an anode stack is shown comprising anode 125 and base assembly 150. Assembly 150 includes conductor disc 155, dielectric disc 160 and base plate 165, which in this example is shown with temperature sensor 400 embedded therein. The anode stack is positioned horizontally in order to correlate with the distance axis (x-axis) on the graph of FIG. 6A.

As shown in FIG. 6A, the anode stack has different temperature drops across the various components comprising the stack. Beginning at the right most end of anode 125, for both a 50 W and 25 W example, there is shown a temperature drop which has a slope slightly steeper than the temperature drop across, for example, conductor disc 155. Although both anode 125 and disc 155 are conductive, the larger cross-section for disc 155 means that there is less of a temperature drop from one main surface to the other. Also as shown in FIG. 6A, the change in temperature across the anode stack relates to the anode power level. The change in temperature (y-axis) refers to a changing temperature offset of the anode stack above room temperature. Thus, at zero applied anode power level the offset is assumed to be zero.

As a further enhancement, an x-ray source assembly in accordance with an aspect of the present invention could be adjusted to accommodate for changes in room or ambient temperature. In order for the total thermal expansion of the elements contributing to the expansion to be the same at 50 W beam current as at 0 W beam current, then the 0 W base temperature of plate 165 (and hence the connected elements) can be raised to, for example, 40 degrees C. This is shown in FIG. 6A by the dotted line.

FIG. 6B depicts an example of reference temperature less ambient temperature of a component of the anode stack for various anode power levels between 0 and 50 Watts. More particularly, FIG. 6B depicts the reference temperature (derived and shown at 0 W in FIG. 6A) for various tube operating powers. Further, by adding an additional temperature offset to this reference temperature, the same system can accommodate changes in ambient temperature. For example, at 50 W and 20 C, a 0 C reference delta temperature is obtained. If this reference delta temperature is raised to 5 C, then additional heating is to be supplied to maintain this delta temperature at 20 C. However at 25 C, no additional heating is required. In this way, an offset in the reference delta temperature is required at, for example, 20 C, which allows for compensation at higher ambient temperatures.

Figure 7:
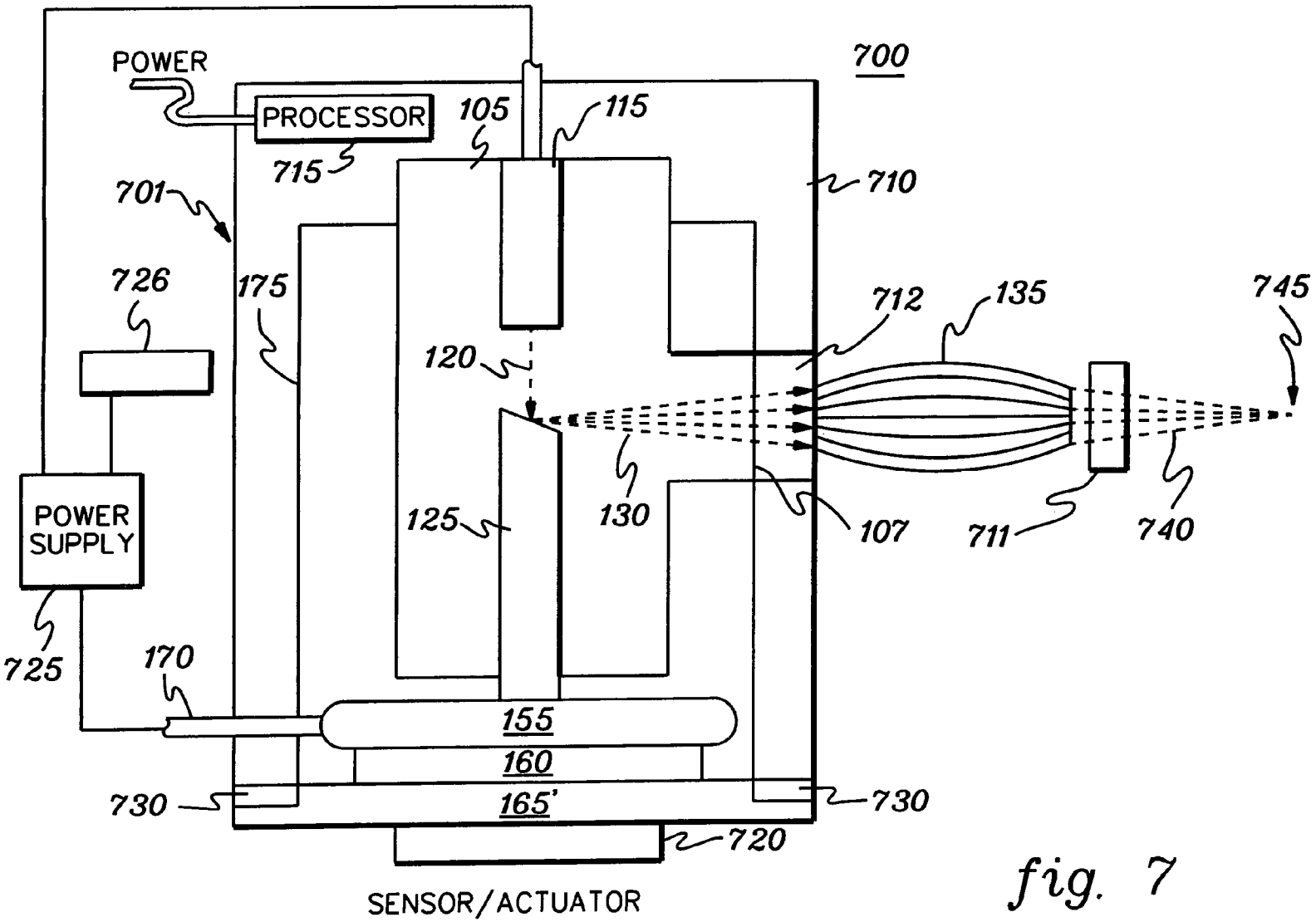
FIG. 7 depicts a cross-sectional view of one embodiment of an enhanced x-ray source assembly, in accordance with an aspect of the present invention.

FIG. 7 illustrates in cross-section an elevational view of one embodiment of an x-ray source assembly, generally denoted 700, in accordance with further aspects of the present invention. X-ray source assembly 700 includes an x-ray source 705 and an output optic 135. Optic 135 is aligned to x-ray transmission window 107 of vacuum x-ray tube 105. X-ray tube 105 again houses electron gun 115 arranged opposite to high voltage anode 125. When voltage is applied, electron gun 115 emits electrons in the form of an electron stream (i.e., electron beam 120 as described above). HV anode 125 acts as a target with respect to a source spot upon which the electron stream impinges for producing x-ray radiation 130 for transmission through window 107 and collection by optic 135. Electron gun 115 and anode 125 function as described above in connection with the embodiments of FIGS. 1, 3 & 4.

Anode 125 is again physically and electrically connected to a base assembly which includes a conductor plate 155 that is electrically isolated from a base plate 165 via a dielectric disc 160. The construction and function of the base assembly could be similar to the base assemblies described above in connection with FIGS. 1, 3 & 4. A high voltage lead 170 connects to conductive plate 155 to provide the desired power level to anode 125. The electron gun 115, anode 125, base assembly 150 and high voltage lead 170 are encased by encapsulant 175 all of which reside within a housing 710. Housing 710 includes an aperture 712 aligned to x-ray transmission window 107 of x-ray tube 105. In operation, x-ray radiation 130 is collected by optic 135, and in this example, focused 740 to a spot 745. As noted above, optic 135 may comprise any one of various types of optical elements, including polycapillary bundles and doubly curved crystals. Also, optic 135 may, for example, comprise a focusing optic or a collimating optic depending upon the application for the x-ray source assembly.

In accordance with an aspect of the present invention, a control system is implemented within x-ray source assembly 700. This control system includes, for example, a processor 715, which is shown embedded within housing 710, as well as one or more sensors and one or more actuators (such as temperature sensor/actuator 720; and/or position actuator 730; and/or intensity sensor 711 and/or power actuator 726), coupled to processor 715 (coupling not shown). This control system within x-ray source assembly 700 comprises functionality to compensate for, for example, thermal expansion of HV anode 125 and the base assembly by modifying the power supplied to the tube by power supply 725 and/or the mechanical alignment of x-rays 130 with respect to optic 135 and/or the temperature of the anode stack. This enables the x-ray source assembly 700 to maintain a spot size 745 with stable intensity within a range of anode operating levels.

Figure 8:
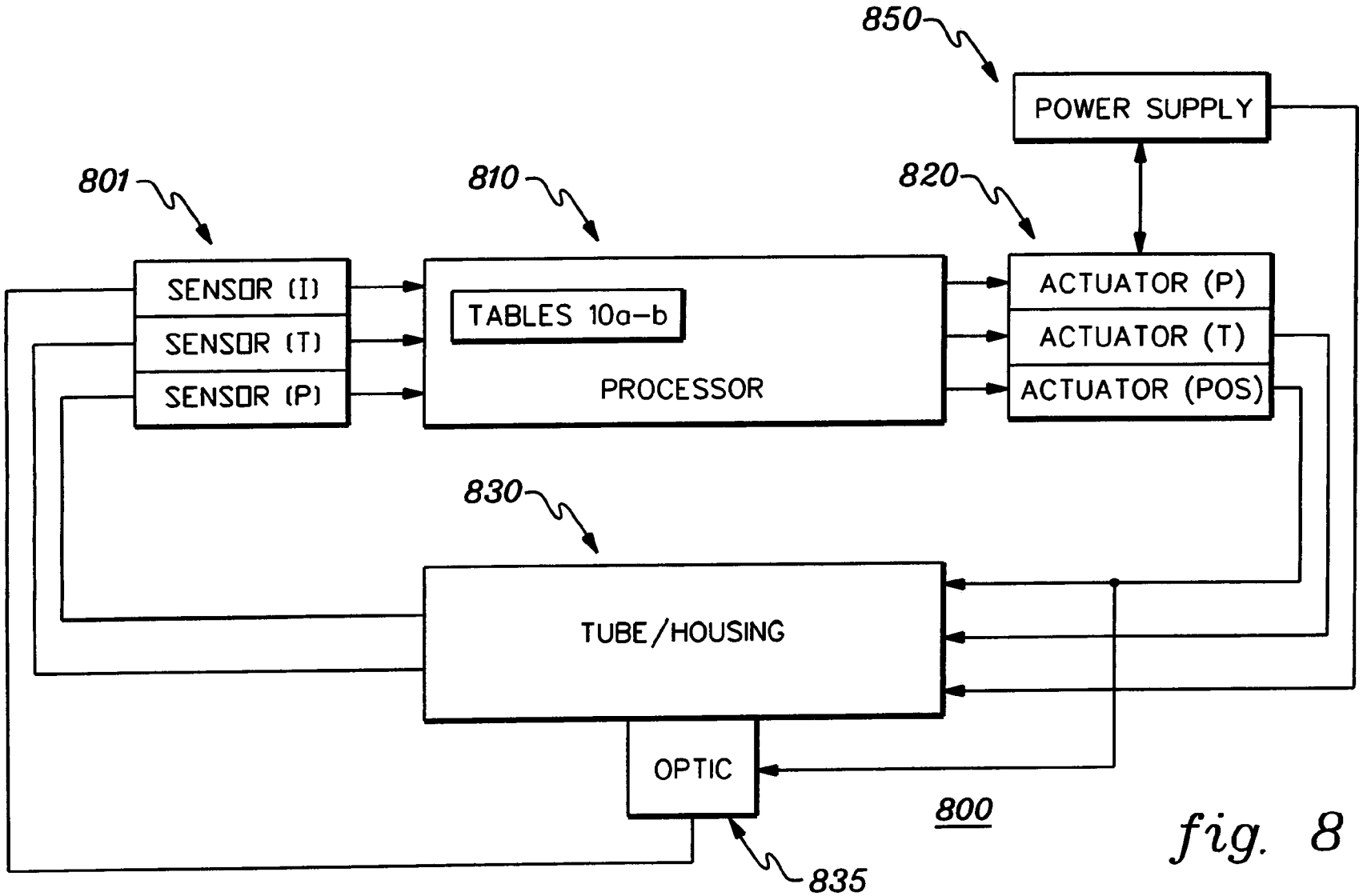
FIG. 8 depicts a block diagram of one embodiment of a control system for an x-ray source assembly, in accordance with an aspect of the present invention.
Figure 8A:
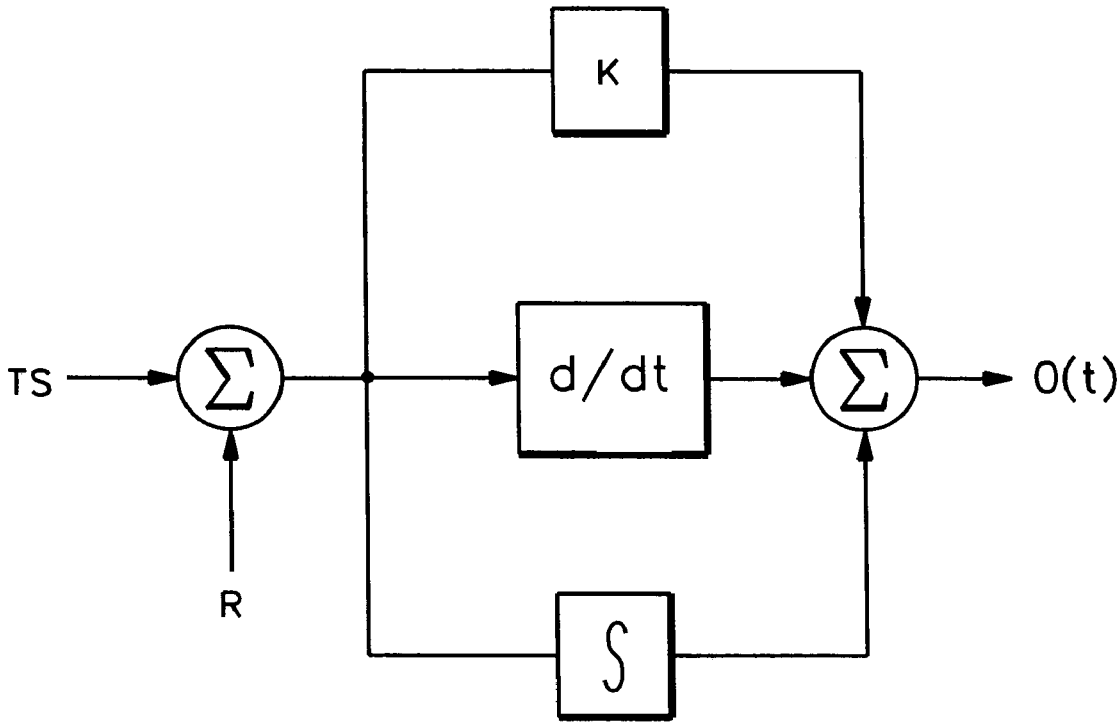
FIG. 8A is a representation of one embodiment of processing implemented by the processor of the control system of FIG. 8, in accordance with an aspect of the present invention.

FIG. 8 depicts one embodiment of a functional control loop and FIG. 8A depicts one example of a control function, in accordance with an aspect of the present invention. As shown in FIG. 8, one or more sensors 801 provide feedback on, for example, temperature from tube/housing 830 ("T") and/or x-ray output intensity from optic 835 ("I") and/or monitored tube power ("P"). The feedback is fed to a processor 810 implementing the control function. By way of example, FIG. 8A depicts a control function wherein a temperature offset is determined between the value from a temperature sensor (TS) and a reference temperature (R) in order that the current position (K), rate of change (d/dt) and accumulated history (E) can be determined. The results of this proportional integral derivative function are then summed to provide an output as a function of time (O(t)). This output is provided to one or more actuators 820 which effect an automatic change in any of the power ("P") supplied to the tube by power supply 850; and or a change in anode temperature ("T"); and/or the position of an output structure 835 (such as the optic) ("Pos"), thus maintaining the anode source spot location relative to the output structure; and/or the output intensity of the optic even in the presence of a misalignment. This monitoring and adjustment process could be continuously repeated by the control system of the x-ray source assembly.

In one improved aspect in the temperature control area, control operation may include using the continuous output of a PID type controller and actuating one or more individual temperature control elements, such as a heating element (heater) and a cooling element (fan), so that the total thermal response of the one or more elements is a mix of the effects of the individual elements to produce the most accurate and timely response for overall thermal control. The mixing of two or more effects can, but not necessarily does, account for differing or disparate magnitudes of response of the overall system to the elements individually. The overall thermal and power response is therefore uniform and finely controllable, avoiding discontinuous control actions and oscillatory limit cycles in overall system response. The method of mixing one or more effects can, but does not necessarily have to include modeling the response of the system to each element separately and combining the models for each actuator to simulate the existence of a single, virtual element that is modulated by a single output variable of a controller such as a PID control. Such a virtual actuation of multiple elements may include the use of one or more forward and reverse commands, all specified at any given time by the overall command to the virtual actuator, but individually applied to each physical element to produce the overall, synchronized, continuous result in control response.

While the above example is applied to disparate temperature control elements, the same principles can be applied to the actuators controlling other types of controllable stimuli discussed herein, including power and physical position. This can be done to the extent that separate elements can be employed to collectively control the output parameter (i.e., temperature or power).

Returning to FIG. 7, sensor/actuator 720 could include a temperature actuator physically coupled to base plate 165'. This temperature actuator 720 could comprise for example, any means for applying heat and/or applying cooling to base plate 165' to add/remove heat to/from the base plate. By way of example, the heating element might comprise a 10 Ohm power resistor such as model number MP850 available from Caddock Electronics of Riverside, Calif., while an appropriate cooling element might comprise a forced air heat sink or a liquid based heat sink. The temperature actuator can be utilized during operation of the x-ray source assembly to maintain the anode x-ray spot at an optimum orientation with respect to one or more output structures such as the x-ray collection optic. The application of heat or removal of heat from the base plate is accomplished so that a consistent average temperature is maintained across the anode stack throughout operation of the x-ray source assembly notwithstanding change in one or more operating conditions of the assembly.

Specifically, in one embodiment, the thermal expansion of the base assembly and HV anode are maintained within a tolerance that enables the generated x-rays to be consistently aligned with, for example, the collection optic throughout the operating ranges of the x-ray source assembly. The addition of applied heat may occur, for example, when the x-ray source assembly shifts to a reduced operating power so that the HV anode and the base assembly elements do not undergo a reduction in size due to a reduced dissipation of heat therethrough, enabling an optimum alignment of x-rays and the collection optic to be maintained. In one embodiment, the heating element could be included internal to the base plate, while the cooling element might be thermally coupled to the exposed surface of the base plate.

Although described herein in connection with maintaining a consistent average temperature across the anode stack, those skilled in the art will recognize that there are other mechanisms for maintaining the desired alignment between the anode source spot and the output structure.

For example, mechanical actuator(s) 730 could be employed to physically adjust the orientation and positioning of the collection optic relative to the anode source spot. These actuators could be manually adjustable or automated so as to be responsive to a signal received from processor 715. Other actuation control mechanisms will also be apparent to those skilled in the art and are encompassed by the claims presented herein. The goal of the control system is to maintain a desired orientation of the anode source spot relative to, e.g., the collection optic input (i.e., focal point). Typically, this desired orientation will comprise the optimum orientation which ensures the highest intensity spot 745.

As another example, the power supplied to the x-ray tube by power supply 725 can by modified to compensate for internal misalignments between the beam 130 and optic 135. Actuator 726 (controlled by processor 715) issues control commands to, and receives status signals from, the controllable power supply 725—which controls the voltage and current supplied to the 115 e-gun and anode 125. Both the voltage and current outputs from the power supply can be controlled. In the preferred embodiment, the power is modified by controlling the current only (known in the art as "tube milliamps")—which is directly proportional to the number of electrons (and therefore x-ray beam intensity) produced.

As discussed in detail above, small misalignments can cause proportionate changes in the output intensity, depending on the operating location along the source/scan curve of FIG. 2. For relatively small changes in location, the tube current can be adjusted (e.g., upward for misalignment) to compensate for the lost intensity—while tolerating the minor misalignment. This adjustment can be used separately from, or in addition to, the other temperature and mechanical adjustments discussed above—as discussed below in connection with FIG. 9*a*.

Changing the voltage (known as the "KeV") between the anode and cathode is a less preferred approach for changing the tube output power because (as known to one skilled in the art) voltage changes impact the shape of the output, x-ray spectrum. This could have significant consequences on the measurements being made by the system, because XRD and XRF systems normally require a predictable spectral shape and content. However, in a monochromatic application where a monochromatizing optic is used as the output optic (e.g., a doubly curved crystal), only one specific x-ray line is used for measurements. Changing the voltage, while impacting the remaining spectrum not of interest, will desirably affect the intensity of the spectral line of interest.

The "closed loop" control of FIG. 8 assumes the ability to sense the relevant tube parameters (power, temperature and/or intensity). An "open loop" embodiment can also be implemented, where certain parameters are modeled and assumed to attain certain values according to pre-existing calibrations or experiments, based on other measured characteristics. The model is then used to adjust the feedback loop, rather than the actual, sensed parameters or in combination therewith.

Figure 9:
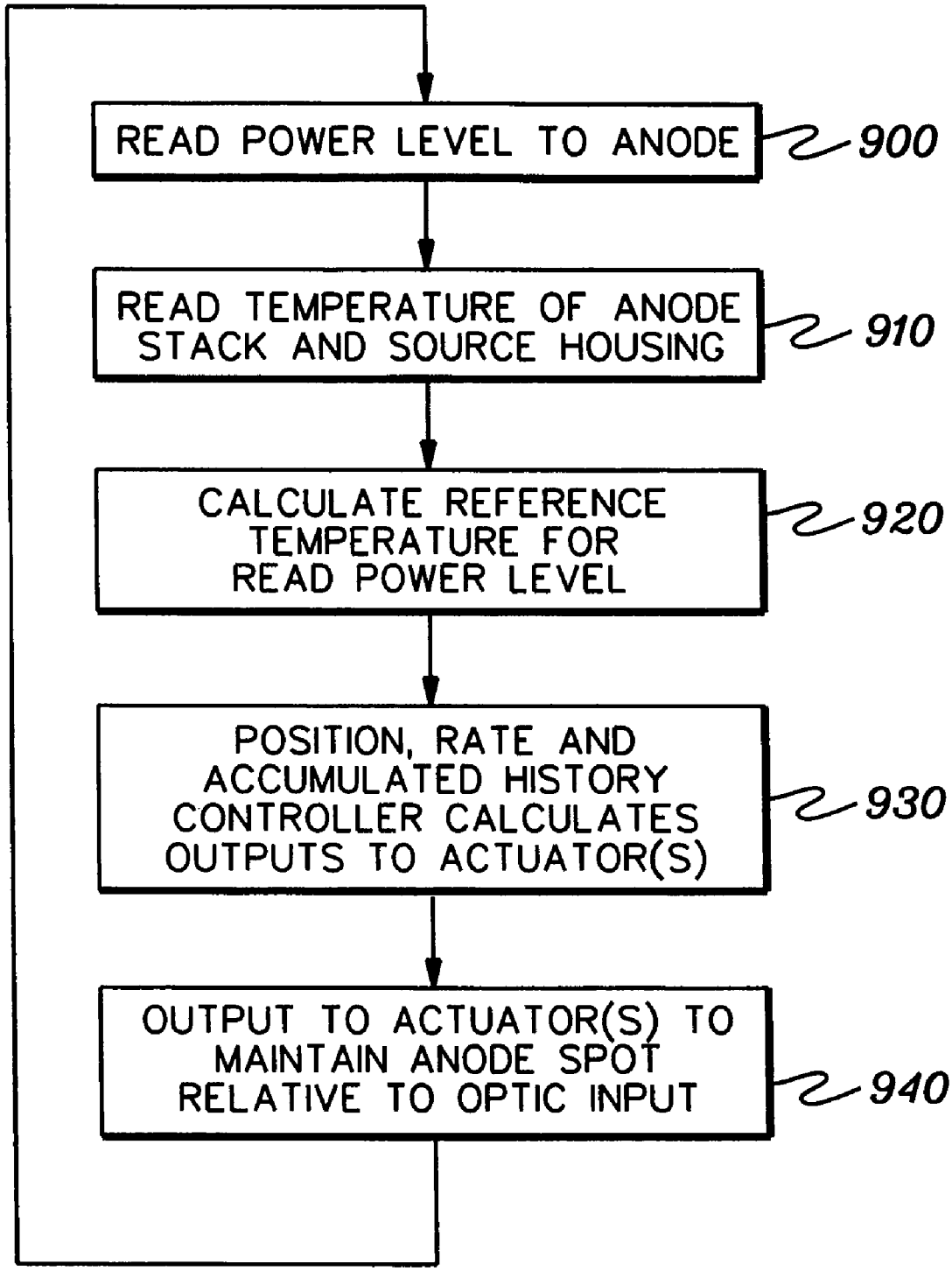
FIGS. 9-9*a* are flowcharts of embodiments of control processing for an x-ray source assembly, in accordance with aspects of the present invention.

FIG. 9 is a flowchart of one embodiment of processing which may be implemented by processor 715 of FIG. 7. FIG. 9 represents a loop which is periodically repeated by the processor during operation of the x-ray source assembly. This can for example, apply or remove heat from the base assembly in response to a change in one or more operating conditions, such as the power level applied to the anode, and thereby maintain a consistent average temperature across the anode stack and thus enable the emitted x-rays to be optimally aligned with respect to the input of the collection optic.

As shown in FIG. 9, processing begins by reading the anode power level 900. In one embodiment, the anode power level can be determined from two analog inputs whose signals range, for example, between 0 and 10 V. One input communicates the voltage at which the power supply supplying power to e-gun 115 (FIG. 7) is operating, while a second input communicates the current being drawn by the power supply. From these two inputs, the power at which e-gun 115 is operating may be determined, which is also the power level of the anode.

Processing next reads the temperature of the anode stack as well as the source housing 910. As noted above, the temperature of the anode stack can be obtained from the base plate of the base assembly using a temperature sensor, with the resultant signal fed back to the processor embedded within the assembly. The housing temperature also could comprise a temperature sensor, which in one embodiment, would be thermally coupled to a surface of the housing in order to measure expansion or contraction of the enclosure. The desirability of measuring housing temperature assumes that the optic or other output structure being monitored is mechanically coupled to the housing.

Next, processing determines a reference temperature for the read power level 920. The reference temperature would be a desirable predetermined temperature for the anode stack at the measured anode power level. Reference temperatures could be determined during a calibration procedure for the x-ray source assembly, and may either be unique to a particular assembly or generic to a plurality of identically manufactured x-ray source assemblies. FIG. 10 depicts one embodiment of a table which could be employed in order to look up the reference temperature for a read power level. As shown, the table of FIG. 10 also employs the housing temperature as another operating condition to be considered in determining the desired reference temperature for the anode stack. Thus, depending upon the housing temperature for the x-ray source assembly and the anode power level, a desired reference temperature for the anode stack is obtained.

The reference temperature and the read temperatures are fed to a position, rate and accumulated history control algorithm such as described above in connection with FIG. 8. The algorithm is employed to calculate the outputs to the one or more actuators 930. One of ordinary skill in the art can readily implement a proportion integral derivative algorithm to accomplish this function. Once the output is obtained, the output is provided to the actuator(s) in order to, for example, maintain the anode source spot location relative to the optic input 940.

As one specific example, the processor could output a signal which comprises a pulse width modulated signal that enables the cooling fan to operate at a range of rotational speeds, and thereby remove heat at an appropriate rate from the base plate of the anode stack. The duty cycle is such a pulse width modulated output can be determined by the operating power of the anode. A second output could enable variation in the power supplied to the heating element, and thereby variations in the amount of heat added to the base plate of the anode stack. In one embodiment, the processor, after performing the proportional integral differential (PID) algorithm, could utilize a formula or a look-up table to determine the temperature that the base plate of the anode stack should be maintained at (i.e., reference temperature) for a particular power level at which the anode is currently operating.

As an alternative to the above-described feedback based algorithm, the processor could implement (by way of example) a model or predictive based algorithm. As an example of a predictive based algorithm, the source and optic could be intentionally misaligned in order to identify an accurate starting position on a known source scan curve. For example, the source and optic alignment could be misplaced to a high slope position on the source scan curve, thereby allowing the displacement to be accurately measured or inferred. Thereafter, using the determined displacement, an adjustment can be made using the source scan curve to return to the peak of the curve.

Figure 9A:
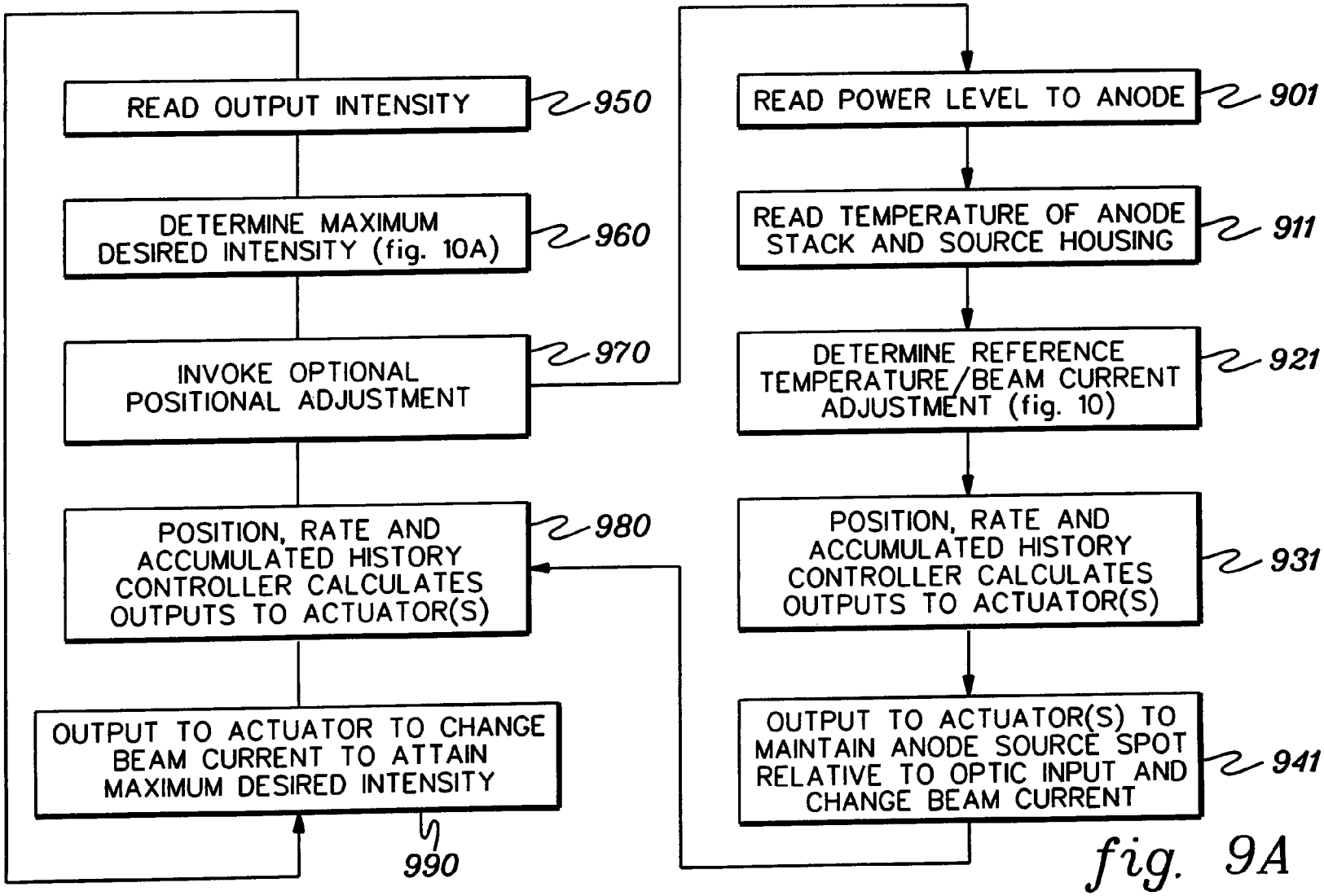

FIG. 9*a* is a flow diagram of an enhanced embodiment of the present invention including for closed loop sensing of output intensity and making corresponding power adjustments.

The output intensity is initially read 950 from, e.g., the sensor 711 of FIG. 7. To prevent a runaway condition, a preexisting table (FIG. 10*a*) can be queried 960 to determine the maximum desired intensity according to the user's voltage and current settings. (The ultimate voltage and current settings may be slightly different from those "chosen" by the user, because of the power adjustments potentially made by the present invention.) Based on the read intensity, an "inner loop" comprising steps 901-941 can optionally be invoked to make certain additional temperature, beam current, and positional changes. Steps 901-941 are similar to steps 900-940 discussed above with reference to FIG. 9, but are themselves enhanced in this embodiment.

Here, the table of FIG. 10 is also supplemented with beam current adjustment parameters predicted/modeled/a-priori derived as a function of the housing temperature and tube power. Then, the requisite adjustments are made 941 according to this enhanced table.

The outer loop can also be continued 980, to make yet another power adjustment 990 based on the actual output intensity read in step 950. In this manner, the inner loop uses the model table 10 according to the read power 901, to make temperature, positional and/or beam current adjustments; and the outer loop makes a final power adjustment to meet the desired intensity level, clamped by the maximum desired intensity table of FIG. 10*a*.

While the exemplary intensity adjustments (950-990) are depicted as an outer loop in this figure, one skilled in the art will recognize that this particular series of steps can alternatively form an inner loop to the temperature/positional adjustments (901-941).

The power adjustments of the present invention (whether made by the user or the control system disclosed) are considered to be intentional changes. The system considers tube power a potentially changing operating condition also, and the control system, while actively changing power under certain circumstances, also compensates for unintended changes in power—with corrections in power or position or temperature. These intentional power changes may clamped according to predetermined criteria to avoid oscillatory behavior of the control loop when responding to unintentional power drift. In this manner, combined control response will not destabilize the power set points established by the user.

The present invention therefore employs a variety of actuators and sensors with the goal of keeping the output intensity of the system constant, in view of changing operating conditions. This is especially important for many measurement instruments reliant upon a constant, stable x-ray beam.

Although preferred embodiments have been depicted and described in detail herein, it will be apparent to those skilled in the relevant art that various modifications, additions, substitutions and the like can be made without departing from the spirit of the invention and these are therefore considered to be within the scope of the invention as defined in the following claims.

The present invention can be included in an article of manufacture (e.g., one or more computer program products) having, for instance, computer usable media. The media has embodied therein, for instance, computer readable program code means for providing and facilitating the capabilities of the present invention. The article of manufacture can be included as a part of a computer system or sold separately.

Additionally, at least one program storage device readable by a machine embodying at least one program of instructions executable by the machine to perform the capabilities of the present invention can be provided.

The flow diagrams depicted herein are just examples. There may be many variations to these diagrams or the steps (or operations) described therein without departing from the spirit of the invention. For instance, the steps may be performed in a differing order, or steps may be added, deleted or modified. All of these variations are considered a part of the claimed invention.

Although preferred embodiments have been depicted and described in detail herein, it will be apparent to those skilled in the relevant art that various modifications, additions, substitutions and the like can be made without departing from the spirit of the invention and these are therefore considered to be within the scope of the invention as defined in the following claims.

What is claimed is:

1. An x-ray source assembly comprising:

an anode having a spot upon which electrons impinge based on power level supplied to the assembly;

an optic coupled to receive divergent x-rays generated at the spot and transmit output x-rays from the assembly; and a control system for maintaining intensity of the output x-rays dynamically during operation of the x-ray source assembly to compensate for misalignment between the anode spot and the optic, wherein the control system maintains the output intensity notwithstanding a change in at least one operating condition of the x-ray source assembly, by changing the power level supplied to the assembly.

2. The x-ray source assembly of claim 1, wherein the control system includes at least one actuator for effecting the change in the power level supplied to the assembly.

3. The x-ray source assembly of claim 2, wherein the at least one actuator comprises a power control actuator for controlling a power supply associated with the assembly.

4. The x-ray source assembly of claim 2, wherein the control system also changes the temperature and/or the position of the anode to maintain the output intensity, and the at least one actuator comprises another actuator:

for adjusting position of at least one of the anode source spot and the output structure; and/or for performing at least one of heating and cooling of the anode and thereby effectuating adjustment of the anode relative to the optic.

5. The x-ray source assembly of claim 1, wherein the control system further includes at least one sensor for providing feedback related to output intensity.

6. The x-ray source assembly of claim 5, wherein the at least one sensor comprises a sensor for monitoring the output intensity.

7. The x-ray source assembly of claim 6, wherein the at least one sensor comprises at least one additional sensor for monitoring:

anode power level; and/or directly or indirectly the anode temperature.

8. The x-ray source assembly of claim 1, wherein the optic comprises at least one of a focusing optic and a collimating optic.

9. The x-ray source assembly of claim 8, wherein the optic comprises one of a polycapillary optic or a doubly curved crystal.

10. The x-ray source assembly of claim 1, wherein the at least one operating condition comprises an unintentionally changing anode power level.

11. The x-ray source assembly of claim 1, wherein the at least one operating condition further includes ambient temperature about the x-ray source assembly.

12. The x-ray source assembly of claim 1, wherein the at least one operating condition further includes a housing temperature of the x-ray source assembly.

13. The x-ray source assembly of claim 1, wherein the power level is changed by adjusting x-ray tube milliamps and therefore x-ray beam intensity from the anode.

14. A method of operating an x-ray source assembly, comprising:

impinging electrons on an anode spot based on a power level supplied to the assembly;

receiving divergent x-rays generated at the spot and transmit output x-rays from the assembly using an optic; and maintaining intensity of the output x-rays dynamically during operation of the x-ray source assembly to compensate for misalignment between the anode spot and the optic, notwithstanding a change in at least one operating condition of the x-ray source assembly, by changing the power level supplied to the assembly.

15. The method of claim 14, further comprising:

adjusting position of at least one of the anode source spot and the output structure; and/or performing at least one of heating and cooling of the anode and thereby effectuating adjustment of the anode relative to the optic.

16. The method of claim 14, further comprising: monitoring the output intensity.

17. The method of claim 16, further comprising:

monitoring anode power level; and/or directly or indirectly monitoring the anode temperature.

18. The method of claim 14, wherein the optic comprises at least one of a focusing optic and a collimating optic.

19. The method of claim 18, wherein the optic comprises one of a polycapillary optic or a doubly curved crystal.

20. The method of claim 14, wherein the at least one operating condition comprises an unintentionally changing anode power level.

21. The method of claim 14, wherein the at least one operating condition further includes ambient temperature about the x-ray source assembly.

22. The method of claim 14, wherein the at least one operating condition further includes a housing temperature of the x-ray source assembly.

23. The method of claim 14, wherein changing the power level changing adjusting x-ray tube milliamps and therefore x-ray beam intensity from the anode.

* * * * *